US005573235A

United States Patent [19]

Asai

[11] Patent Number: 5,573,235

[45] Date of Patent: Nov. 12, 1996

[54] PAPER SHEET FEEDER DEVICE

[75] Inventor: Yosinori Asai, Shizuoka-ken, Japan

[73] Assignee: Kabushiki Kaisha TEC, Shizuoka, Japan

[21] Appl. No.: 412,763

[22] Filed: Mar. 29, 1995

[30] Foreign Application Priority Data

Mar. 30, 1994 [JP] Japan ..... 6-061383

[51] Int. Cl.[6] ..... B65H 3/52

[52] U.S. Cl. ..... 271/121; 271/127; 271/162; 271/171

[58] Field of Search ..... 271/121, 124, 271/127, 126, 160, 157, 162, 171

[56] References Cited

U.S. PATENT DOCUMENTS

| | | | |
|---|---|---|---|
| 4,582,314 | 4/1986 | Yamamoto et al. | 271/127 |
| 5,186,448 | 2/1993 | Ohsawa et al. | 271/121 |
| 5,219,155 | 6/1993 | Kanome | 271/127 |
| 5,437,444 | 8/1995 | Kawakami et al. | 271/121 |

FOREIGN PATENT DOCUMENTS

| | | | |
|---|---|---|---|
| 1-321239 | 12/1989 | Japan . | |
| 0127333 | 5/1990 | Japan | 271/121 |
| 2195614 | 4/1988 | United Kingdom | 271/121 |

*Primary Examiner*—H. Grant Skaggs
*Attorney, Agent, or Firm*—Frishauf, Holtz, Goodman, Langer & Chick

[57] ABSTRACT

A paper sheet feeder device for a printer apparatus includes a plate on which a stack of paper sheets is mounted, a paper feeder roller arranged above the front end of the paper feeder plate and rotated to pick up the paper sheets from the paper feeder plate, a cover for supporting the paper feeder plate to cause the paper sheets to be in contact with the paper feeder roller, and a paper sheet separator pad arranged adjacent to the front end of the paper feeder plate to introduce the paper sheets from the paper feeder plate to a certain position on the outer circumference of the roller and cooperate with the roller to separate the top one from the other paper sheets on the paper feeder plate. In particular, the cover includes a projecting section for freely swingably supporting the rear end of the paper feeder plate when it is projected outside through an opening formed in a side of the printer apparatus, and a spring for urging the paper feeder plate to the roller.

13 Claims, 6 Drawing Sheets

PAPER SHEET FEEDER DEVICE

BACKGROUND OF THE INVENTION

1. Field of the Invention

The present invention relates to a paper sheet feeder device usually incorporated into a printer and more particularly, a paper sheet feeder device capable of feeding paper sheets one by one from a stack of paper sheets received on it.

2. Description of the Related Art

Printers, facsimiles, copying machines are usually well-known to print letters and images on paper sheets by electrophotographic process. These machines include a device for feeding paper sheets one by one from a stack of paper sheets mounted at a certain position on it.

A conventional paper sheet feeder device 10 shown in FIG. 1 includes a feeder roller 11 and a paper sheet mounted plate 30. A rear end 30B of the paper sheet mounted plate 30 is swingably supported round a pin 31 and a front end 30T thereof is urged against the feeder roller 11 by a spring 39. Further, the paper sheet feeder device 10 includes a paper sheet separator mechanism 15 comprising a holder member 16 swingably supported by a rod 19, a paper sheet separator pad 17 made by cork and bonded on the top of the holder member 16, and a spring 18 for urging the paper sheet separator pad 17 against the feeder roller 11.

When the feeder roller 11 is rotated while keeping a stack of paper sheets mounted on the plate 30, a top sheet of paper is picked up by the feeder roller 11 and fed to a paper sheet conveyer system 70 through a point Q. When the forward edge of the paper sheet is nipped between the rollers 71 ad 72, the sheet is further conveyed in a direction X as the rollers 71 and 72 are rotated. The sheet is then conveyed to a printing position (not shown) by the paper sheet conveyer system 70. The paper sheet separator mechanism 15 serves to separate a sheet of paper from two or more entering between the feeder roller 11 and the pad 17.

A cover 50 serves to selectively cover an opening 2 formed in a side of the printer apparatus and it can swing into a housing 1 of the printer apparatus round a rod 51 by which its rear end is supported. It opens the opening 2 as shown by a solid line and closes it as shown by a dot and dash line. When a stack of paper sheets is mounted on the plate 30 through the opening 2, rear ends of these paper sheets are supported by the cover 50.

When a stack of paper sheets is to be mounted on the plate 30, front end portion of these paper sheets must be sandwiched between the feeder roller 11 and the plate 30. To achieve this, the plate 30 is pushed down against the spring 39 by one hand while the stacked paper sheets are mounted on the plate 30 by the other hand.

The paper sheet feeder device 10 shown in FIG. 1, however, has the following drawbacks.

A stack of paper sheets must be supplied while pushing down the plate 30 by one hand. If the plate 30 is pushed down to an excessive level, too many paper sheets are mounted on the plate 30, as shown in FIG. 10B. An angle θ at which the stacked paper sheets enter onto the separator pad 17 becomes larger as the stacked paper sheets become higher. As the angle θ becomes larger, therefore, paper sheets are more likely to stay at a position where their front end portions contact the pad 17. This causes sheet jamming in the printer apparatus. Further, if one hand is released from the plate 30 when the mounting of the stacked paper sheets is not finished on the plate 30 yet, the plate 30 is rapidly sprung up by the spring 39. Excessive shock is thus added to an actuator for the paper sheet detector, and other components, thereby causing them to be broken. To avoid this, a careful work must be needed but this causes quick paper sheet supply to be disturbed.

SUMMARY OF THE INVENTION

The object of the present invention is therefore to provide a paper sheet feeder device capable of more smoothly supplying paper sheets.

According to the present invention, there can be provided a paper sheet feeder device suitable for use with a printer apparatus comprising a paper feeder plate on which a stack of paper sheets is mounted; a paper feeder roller arranged above the front end of paper feeder plate and rotated to pick up the paper sheets one by one from the paper feeder plate; a mechanism for supporting the paper feeder plate while contacting the paper sheets with the paper feeder roller; and a paper sheet separator pad arranged adjacent to the front end of the paper feeder plate to introduce the paper sheets from the paper feeder plate to a certain position on the outer circumference of the paper feeder roller and cooperate with the roller to separate the top one from the paper sheets; wherein the support mechanism includes a support section for swingably supporting the rear end of the paper feeder plate while keeping it projected outside through an opening formed in a side of the printer apparatus, and an urging section for urging the paper feeder plate to the roller.

In the paper sheet feeder device, the paper feeder plate is pushed down, when a stack of paper sheets is to be mounted on a certain position of the paper feeder plate, and it is swung to urge front ends of the paper sheets against the paper feeder roller by force added from the urging section. The extent to which the paper feeder plate is pushed down, that it, the extent to which it is swung round the support section is determined by the height of the paper sheets supported between the paper feeder roller and plate. When the paper sheets are too many, the paper feeder plate is swung to a greater extent and the angle at which the paper sheets are fed onto the separator pad is thus made such a value as easily causes paper sheet jamming. In the paper sheet feeder device of the present invention, however, the above-mentioned support mechanism serves to support the rear end of the paper feeder plate which is positioned outside the opening. The front end of the paper feeder plate can be separated enough from its swinging fulcrum. The angle of the swingable paper feeder plate which must be changed as the height of paper sheets changes can be kept smaller in this case. As the result, the angle of paper sheets fed can be set in an appropriate range not to cause any paper sheet jamming. The paper sheets can be therefore more smoothly supplied to printing position.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DETAILED DESCRIPTION OF THE PREFERRED EMBODIMENTS

The printer apparatus according to an embodiment of the present invention will be described with reference to the accompanying drawings. This printer apparatus serves as a copying machine, for example.

Figure 2:
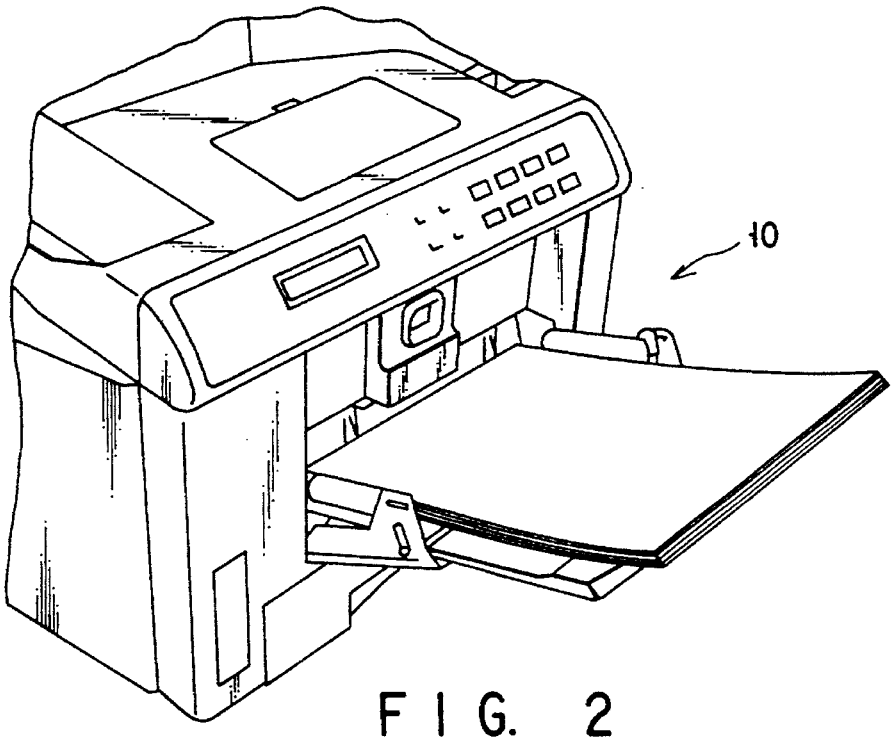
FIG. 2 shows the printer apparatus according to an embodiment of the present invention.

FIG. 2 shows the appearance of the printer apparatus, which is provided with a paper sheet feeder unit 10 for feeding paper sheets one by one to a printing position where letters and image information are printed.

Figure 3:
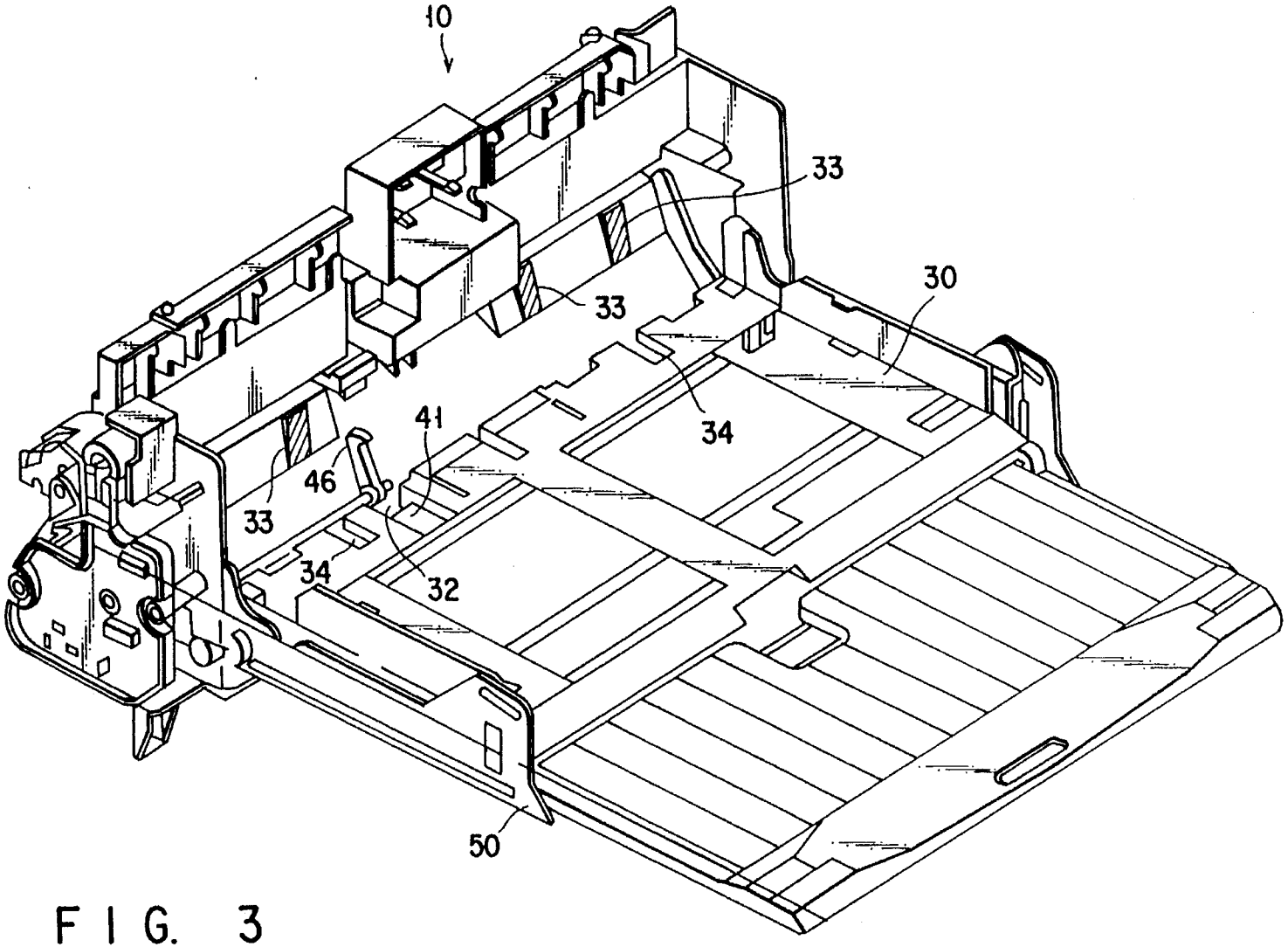
FIG. 3 is a perspective view showing a paper sheet feeder unit incorporated into the printer apparatus shown in FIG. 2.
Figure 4:
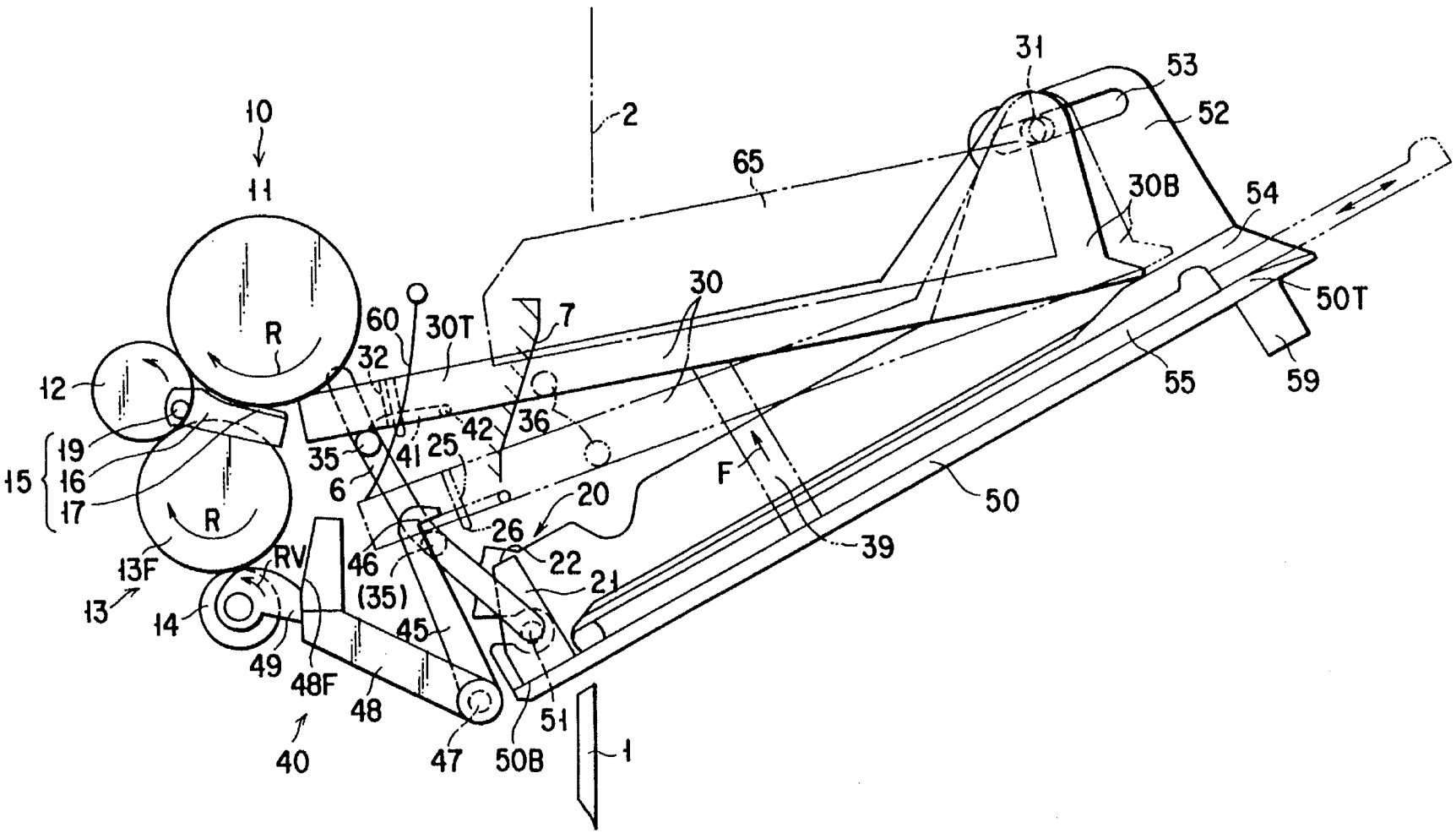
FIG. 4 shows the paper sheet feeder unit in more detail.

As shown in FIGS. 3 and 4, the paper sheet feeder unit 10 includes a paper feed plate 30 on which a stack of paper sheets is mounted, a paper feeder roller 11 arranged above and adjacent to a front end portion 30T of the paper feed plate 30 and rotated clockwise in a direction R, and a paper sheet separator mechanism 15 arranged adjacent to the front end portion 30T of the paper feed plate 30 and below the paper feeder roller 11.

The paper sheet separator mechanism 15 includes a holder member 16 swingably supported by a rod 19, a paper sheet separator pad 17 made by cork and bonded on the top of the holder member 16, and a spring (not shown) by which the separator pad 17 is urged against the feeder roller 11.

A housing 1 of the printer apparatus has an opening 2, which is selectively opened and closed by a cover 50 to enable a stack of paper sheets on the paper feed plate 30 to be set in the printer apparatus. A front end portion 50T of the cover 50 swingably supports a rear end portion 30B of the paper feed plate 30. A front end portion 30T of the paper feed plate 30 is urged against the paper feeder roller 11 by a spring 39 attached to the cover 50.

A rear end 50B of the cover 50 is swingably supported round a rod 51. The cover 50 swings round the rod 51 to selectively open or close the opening 2 of the housing 1. A pair of portions 52 are erected and opposed to each other on the front portion 50T of the cover 50 to sandwich the paper feed plate 30 between them and each of the erected portions 52 has a slot 53. The cover 50 has a housing chamber 54 in which a paper tray 55 can be housed. The paper tray 55 can be pulled in the housing chamber 54 in a direction shown by a two-dot and dash line to hold the rear end portion of the stacked paper sheets when paper sheets each having a length larger than that of the paper feed plate 30 are stacked on the plate 30. A cover opening and closing knob 59 is attached to the front end 50T of the cover 50.

The rear end 30B of the paper feed plate 30 is provided with a pair of erected portions opposed to each other sandwiching an area of the paper feed plate 30 on which a stack of paper sheets are mounted. The erected portions have a pin 31 which can be slid and rotated in the slots 53. When the cover 50 is opened, therefore, the pin 31 and the slots 53 serve to slide the rear end 30B of the paper feed plate 30 along the slots 53 and also to set the front end 30T thereof under the paper feeder roller 11. The front end 30T of the paper feed plate 30 is urged against the paper feeder roller 11 by the spring 39 arranged between the plate 30 and the cover 50.

The spring 39 is apparent in FIGS. 4 and 7 but it is arranged in fact between a follow pin 36 and a rod 42 which will be described later. A pair of guide plates 65 are arranged on the paper feed plate 30, opposing to each other to define the area of the plate 30 on which a stack of paper sheets is mounted.

Figure 1:
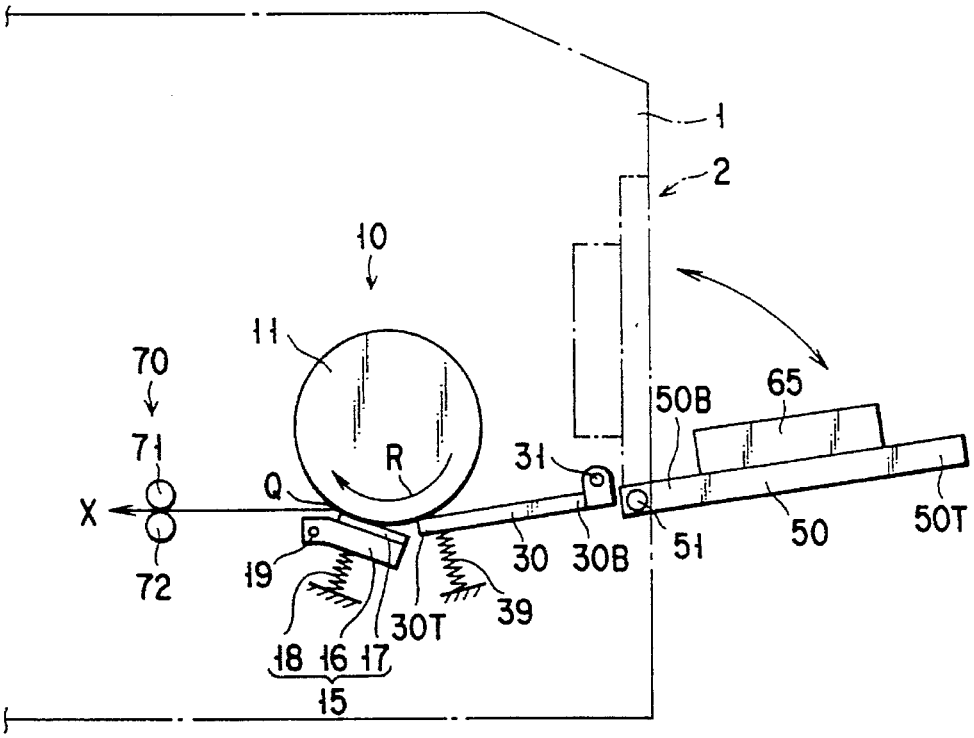
FIG. 1 shows the inside arrangement of a conventional paper sheet feeder device.

The rear end 30B serving as a center round which the paper feed plate 30 is swung is attached to the front end 50T of the cover 50 which can be projected outside the housing 1 to a greater extent to open the opening 2. As compared with the conventional paper feeder device shown in FIG. 1, therefore, the length of the paper feed plate 30 can be made by far larger. Even if the height of paper sheets stacked on the paper feed plate 30 changes, therefore, the change of that angle by which the paper feed plate 30 must be swung to respond to the change of the height can be made smaller. The change of that angle at which the stacked paper sheets enter onto the separator pad 17 can be thus made extremely smaller.

Figure 10A:
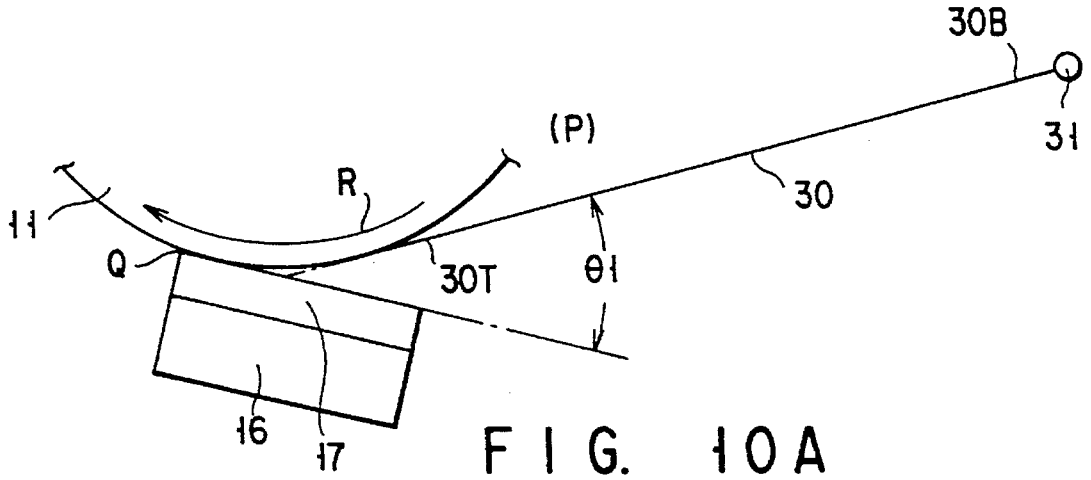
FIGS. 10A and 10B show how angles at which stacked paper sheets enter onto the separator pad are different when the stacked paper sheets are set to have first and second heights.
Figure 10B:
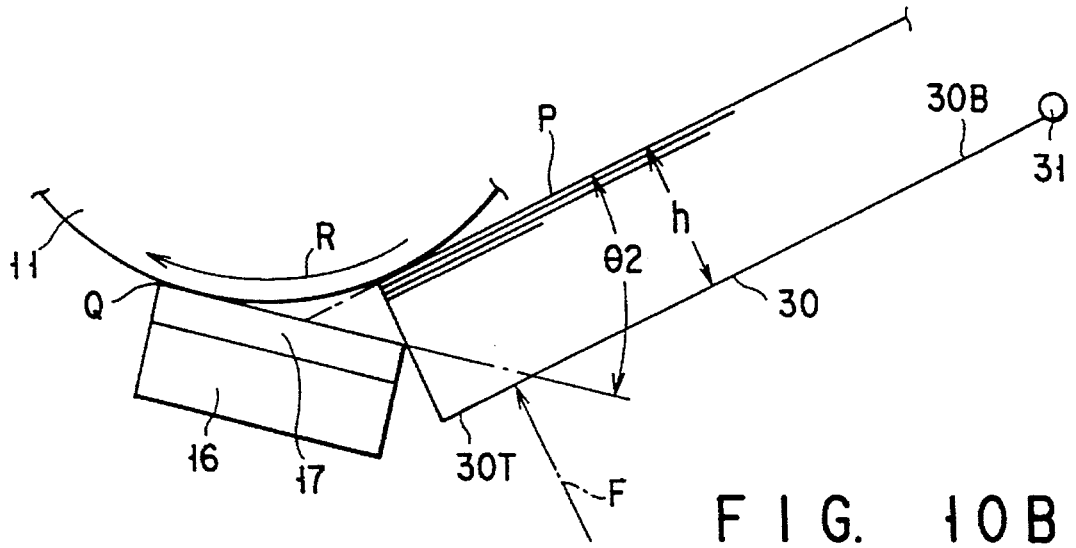

More specifically, the entering angle of stacked paper sheets is determined by how the paper feed plate 30 is tilted to the separator pad 17 also tilted, as shown in FIGS. 10A and 10B. In the case of this example, the optimum angle at which the stacked paper sheets P can be smoothly fed onto the separator pad 17 is "θ1" as shown in FIG. 10A. As the height h of paper sheets P stacked on the paper feed plate 30 becomes larger as shown in FIG. 10B, the front end 30T of the paper feed plate 30 is pushed down to a greater extent against the urging force F of the spring 39. The rear end 30B of the paper feed plate 30 is swingably supported by the cover 50 through a pin 31. When the front end 30*t* thereof is pushed down as described above, therefore, the paper feed plate 30 is swung and tilted.

When the whole length (from a fulcrum round which the paper feed plate 30 is swung to the front end thereof) of the paper feed plate 30 is small as seen in the case of the conventional paper feeder device, however, the angle at which paper sheets stacked on the paper feed plate 30 enter onto the separator pad 17 becomes relatively larger as shown by "θ2" in FIG. 10B because the separator pad 17 is kept tilted at a certain angle. When the entering angle of stacked paper sheets is large like this, the font end of stacked paper sheets P is struck against the separator pad 17 at a nearly right angle. As the result, the front end of stacked paper sheets P cannot advance to the contact point Q between the feeder roller 11 and the pad 17. The jamming of paper sheets is thus caused.

In the case of this example, however, the rear end 30B of the paper feed plate 30 can be projected enough outside the housing 1. In short, the length extending from the fulcrum round which the paper feed plate 30 is swung to the front end of the plate 30 can be made larger enough, as compared with the conventional paper feeder device. Even if a great more paper sheets are stacked on the paper feed plate 30, therefore, the above-mentioned optimum entering angle θ1 can be substantially kept to thereby prevent the jamming of stacked paper sheets in the printer apparatus. The upper limit of paper sheets stacked is about 100 sheets and when the number of paper sheets stacked exceeds 100 sheets, paper sheet supplying error and the wrong tilting of paper sheets supplied can be caused. As shown in FIG. 3, regulator members 33 are arranged at certain positions in the paper sheet feeder unit 10 to regulate the front ends of paper sheets stacked on the paper feeder plate 30. The front ends of paper sheets are thus regulated by the regulator members 33.

When the whole length of the paper feeder plate 30 is made long enough, as described above, the jamming of paper sheets can be prevented. When printing operation is stopped, however, a mechanism for housing the paper feed plate 30 compact into the printer apparatus is needed. When the cover 50 is swung round the rod 51 to its closed position after the finish of printing operation while keeping the paper feeder plate 30 urged by the spring 39, however, a large space for the paper feeder plate 30 must be kept in the housing 1. This makes it impossible to make the printer apparatus smaller-sized. A mechanism for housing the paper feeder plate 30 compact inside the cover 50 is therefore provided between the cover 50 and the plate 30. This mechanism comprises the pins 31 attached to the rear end 30B of the paper feeder plate 30, slots 53 provided in the front end 50T (or erected portions 52 at the front end 50T) of the cover 50 and extended in a direction X in which paper sheets are fed in a state of cover opening, guide pins 35 arranged at the front end 30T of the plate 30, and arc-like guide grooves 6 formed to gradually come nearer to the rod 51 from above to below in the housing 1. In this housing mechanism, the pins 31 are swingably and slidably arranged in the slots 53 and the pins 35 are slidably arranged in the guide grooves 6.

Figure 7:
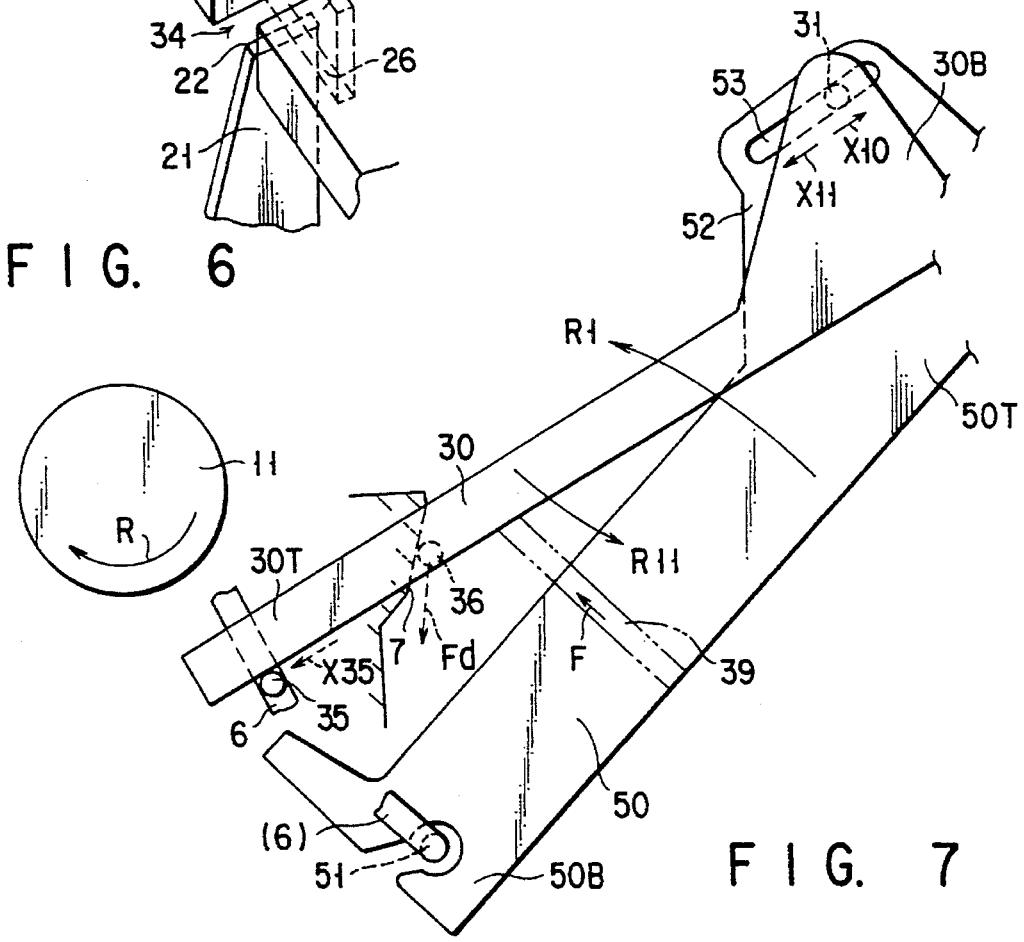
FIG. 7 shows how the paper sheet mounted plate is moved to its used position.
Figure 8:
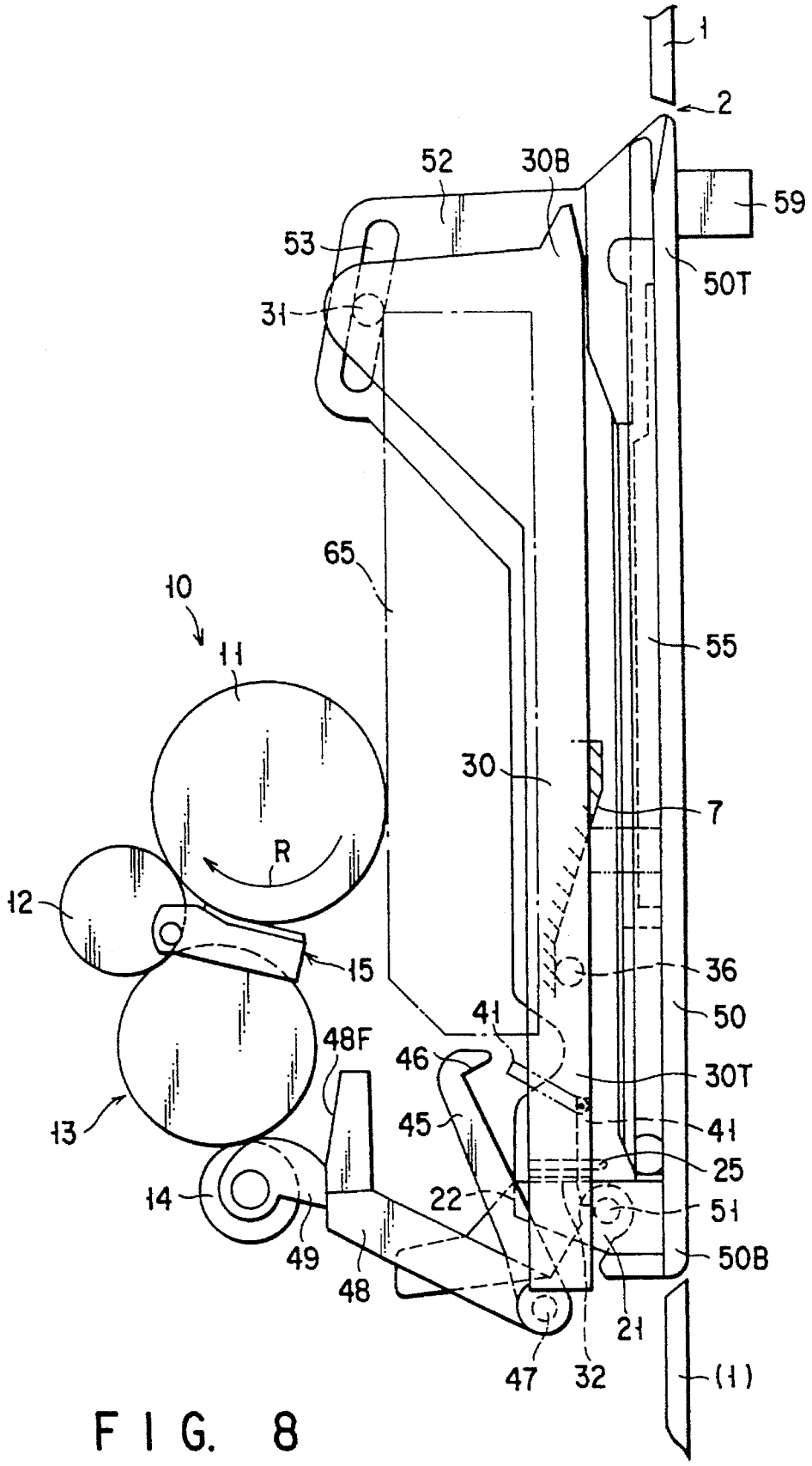
FIG. 8 shows the paper sheet mounted plate housed in the printer apparatus when a cover shown in FIG. 4 is closed.

When the cover 50 is swung round the rod 51 in a direction R1 in FIG. 7, the paper feeder plate 30 is swung round the pins 31 in a direction R11 as guide pins 35 move along the guide grooves 6. When the cover 50 is closed as shown in FIG. 8, therefore, the paper feed plate 30 can be housed, substantially parallel, inside the cover 50, thereby enabling the space needed to be made by far smaller.

Further, a mechanism for generating force to more lightly, easily and smoothly house the paper feeder plate 30 into the cover 50 is provided. This forcing mechanism comprises a tilted guide face 7 and follower pins 36, as shown in FIG. 4. The guide face 7 is tilted, from above to below, into the housing 1 and the follower pins 36 are fixed to the bottom of the paper feeder plate 30.

When the cover 50 is swung round the rod 51 in the direction R1 in FIG. 7, the paper feeder plate 30 is swung round the pins 31 in the direction R11. However, the urging force F of the spring 39 and the weight of the paper feeder plate 30 are added to the guide pins 35 arranged in the guide grooves 6. A case is therefore supposed where a relatively large load is added to the pins 35 because of the shape of the guide groove 6 and because of the sliding resistance of the guide pins 35 in the grooves 6. In short, it is supposed that a load is added to the guide pins 35 in a direction X35.

While using the swinging force obtained when the cover 50 is swung in the direction R1, the forcing mechanism functions to cooperate the follower pins 36 and the tilted guide face 7 with each other to cause the paper feeder plate 30 to generate a pull down force Fd shown in FIG. 7. When the cover 50 is lightly swung in the direction R1, therefore, the housing mechanism (31, 53, 6, 35) serves to more easily house the paper feed plate 30, substantially parallel, into the cover 50.

It is not needed in this case that the guide groove 6 is shaped like an arc. It may have any shapes if the paper feeder plate 30 can be housed, substantially parallel, in the cover 50 and its front end cannot interfere with any of other components (such as the paper feeder roller 11) while it is being housed into the cover 50, when the cover 50 is closed as shown in FIG. 8.

In order to enhance this shape feasibility of the guide groove 6 to a greater extent, slots 53 are provided in the front end 50T of the cover 50 and pins 31 are provided in the rear end 30B of the plate 30 to slide along the slots 53. The pins 31 are moved in a direction X10 by the guide grooves 6 just after the cover 50 is swung in the direction R1 in FIG. 7, for example, and then in a direction X11 when the angle of the cover 50 swung becomes larger than a certain value.

It is not needed, therefore, that the processing accuracy of the paper feed plate 30 and guide grooves 6 is made excessively high. The mechanical matching feasibility of each component can be thus enhanced to a greater extent, thereby shortening their assembly time and reducing the total cost of them.

A lock/unlock system 40 including a mechanism (41, 46) for locking the paper feeder plate 30 at a certain position when the plate 30 is pushed down and another mechanism (49, 48F, 48, 49S, 47, 45, 46) for unlocking the plate 30 will be described with reference to FIGS. 4 and 5.

A cut-away recess 32 is provided in the front end 30T of the paper feeder plate 30 and a lock member 41 swingable round a rod 42 is housed in the recess 32. The lock member 41 is pulled downwards by a spring 44 in FIG. 5 and engaged with a stop bar 43 at the bottom face thereof. A hook member 46 is shaped to lock the lock member 41 and it is held at a certain position (or paper sheet feeding position) by a hook holding link 45. The hook and lock members 46 and 41 can lock the paper feeder plate 30 at the paper sheet feeding position (which will be called paper supply position).

Figure 5:
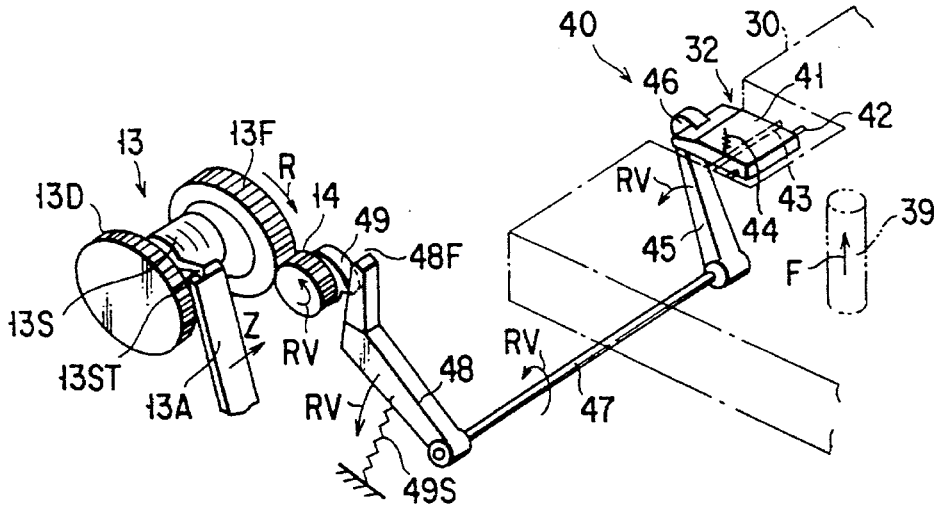
FIG. 5 is a perspective view showing a lock/unlock mechanism for locking and unlocking the paper sheet mounted plate which is pushed down as shown in FIG. 4.

When the paper feeder plate 30 is swung against the urging force F of the spring 39 from its position shown by a solid line to its paper supply position shown by a two-dot and dash line in FIG. 4, the lock member 41 is struck against the hook member 46 and sang upwards by the spring 44 in FIG. 5. When the paper feeder plate 30 is further swung, the lock member 41 which is kept swung upwards comes over the hook member 46 to the underside thereof. When external force added is released from the paper feeder plate 30 under this state, the plate 30 tries to again return to its position shown by the solid line in FIG. 4. However, the top of the lock member 41 is hooked by the underside of the hook member 46 and the underside thereof is locked by the stop bar 43. The paper feeder plate 30 can be thus locked at the paper supply position shown by two-dot and dash line in FIG. 4.

This makes it unnecessary for the operator to supply paper sheets to the paper feeder plate 30 by his one hand while adding external force to the plate 30 against the urging force F of the spring 39 by his other hand, which was usually seen in the case of the conventional paper feeder device. The operator can mount paper sheets more quickly and accurately on the paper feeder plate 30, which has been locked at the paper supply position, by his both hands.

Just after the cover 50 is opened, paper sheets can be set at once on the paper feeder plate 30 without pushing down it. This is because the paper feeder plate 30 housed in the cover 50 is pushed up in the direction shown by the two-dot and dash line in FIG. 4 and automatically locked at the paper supply position when the cover 50 is swung at first from its closed position to its opened one.

On the other hand, the unlock mechanism comprises a cam 49 attached to a cam drive gear 14, a connecting shaft 47 held rotatable at a certain position, a cam follower holding link 48 provided with a cam follower 48F and attached to the connecting shaft 47, a spring 49S and the hook member 46 attached to the hook holding link 45, as shown in FIG. 5. Synchronizing with the rotation of the feeder roller 11, this unlock mechanism automatically unlocks the locking state of the above-described lock mechanism.

When an actuator piece 13A engaged with a spring end 13ST (or spring 13S) of a spring clutch 13 shown in FIG. 5 is moved in a direction Z, responsive to a command applied from the CPU (not shown), the rotating force of a drive gear 13D is transmitted to a follower gear 13F, which is thus rotated in the direction R, thereby causing the paper feeder roller 11 to be rotated in the direction R through an idle gear 12 shown in FIG. 4. The actuator piece 13A is returned to its original position when the paper feeder roller 11 finishes its one rotation.

When the cam 49 is thus rotated in a direction RV in FIGS. 4 and 5 by the cam drive gear 14 toothed with the follower gear 13F, the cam follower holding link 48 is swung in the direction RV in FIG. 5 by the spring 49S. The hook holder member 45 is swung through the connecting shaft 47 to thereby release the hook member 46 from the lock member 41.

The paper feeder plate 30 is thus moved to push stacked paper sheets thereon against the paper feeder roller 11 by the urging force F of the spring 39. In short, the locking state is automatically unlocked or released. As the roller 11 is rotated, it pushes the top paper sheet, feeding the sheet forward. When the cam drive gear 14 rotates one time, the hook member 46 is returned to its original position shown in FIG. 5.

When the cover 50 is closed as shown in FIG. 8, the hook member 46 lifts up the lock member 41, as the cover 50 swings, and the lock member 41 is swung to its position shown by a two-dot and dash line in FIG. 8. Just before the cover 50 is completely closed, the lock member 41 is disengaged from the hook member 46 and returned to its original position shown by a dot and dash line.

A stopper mechanism 20 for defining the lower limit of the paper feeder plate 30 swung will be described.

The stopper mechanism 20 includes a stopper member 21 (or stopper face 22) attached integral to the rear end 50B of the cover 50, and an engaging member 25 (or contacting face 26) attached integral to the front end 30T of the paper feeder plate 30 as shown in FIG. 4. It is arranged on each side of the paper feeder plate 30 to keep the lower limit of the plate 30 (or 30T) swung when a new stack of paper sheets is to be supplied.

When a new stack of paper sheets is to be supplied to the empty paper feeder plate 30, for example, the paper feeder plate 30 is swung round the rod and its front end 30T is further pushed down from its paper supply position shown by the two-dot and dash line in FIG. 4. In short, the front end 30T of the paper feeder plate 30 is moved in a direction Y30 in FIG. 6. When moved so, it is stopped because the face 26 of the engaging member 25 is struck against the stopper face 22 of the stopper member 21.

Figure 9:
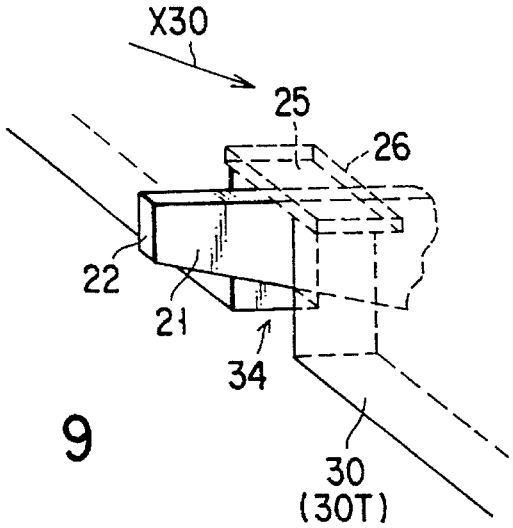
FIG. 9 shows how the front end of the paper sheet mounted plate housed as shown in FIG. 8 is positioned relative to the stopper mechanism.

While the cover 50 is kept closed as shown in FIG. 8, the paper feeder plate 30 (or front end 30T) is moved in a direction X30 in FIG. 9. The stopper face 22 is not struck against the face 26, accordingly. The stopper member 21 is housed in this case in a cut-away recess 34 of the paper feeder plate 30 (or 30T).

It will be described how the above-described paper sheet feeder apparatus is operated.

When the printer apparatus is used, the knob 59 on the cover 50 which is closed is pulled right in FIG. 8. The cover 50 is thus clockwise swung round the rod 51 to thereby be opened as shown in FIG. 4.

The paper feeder plate 30 is pushed, this time, upwards in FIG. 4 by the urging force F of the spring 39. It is therefore swung upwards round its rear end 30B (or pin 31) which is projected outside the housing 1, and its front end 30T (or 35) moves upwards along the guide groove 6. When the lock member 41 is engaged with the hook member 46 while the front end 30T (or 35) is moving from below to above, however, the paper feeder plate 30 is stopped. In short, the paper feeder plate 30 is automatically set at the paper supply position shown by the two-dot and dash line in FIG. 4 by the lock system.

When a stack of paper sheets, each sheet having a large size, is to be mounted, the tray 55 is pulled out as shown by the two-dot and dash line in FIG. 4.

The operator can set a desired number of paper sheets at once on the paper feeder plate 30 and the tray 55 at the same time when he causes the cover 50 to be opened. He is not asked this time to push down the paper feeder plate 30 against the urging force F of the spring 39 by his one hand, which was seen in the paper supply time by the conventional paper sheet feeder device shown in FIG. 1. This enables him to use his both hands to more quickly and accurately mount a stack of paper sheets on the paper feeder plate 30. Further, the stopper mechanism 20 is arranged between the paper feeder plate 30 and the cover 50 and it can prevent the plate 30 from being too excessively pushed down, thereby also preventing an excessive number of paper sheets from being mounted on the plate 30.

When the stacked paper sheets are set on the paper feeder plate 30, as described above, printing command is sent from the CPU (not shown). Responsive to this printing command, the actuator piece 13A in FIG. 5 is urged by a solenoid (not shown) and moved in the direction Z, the spring clutch 13 is made operative and the follower gear 13F is rotated in the direction R. The paper feeder roller 11 is thus rotated in the direction R in FIG. 4.

Synchronizing with this, the unlock mechanism (49, 48F, 48, 49S, 47, 45, 46) operates to forcedly release the hook member 46, which has been locked in FIG. 5, from the lock member 41. When thus automatically released from its locked state, the paper feeder plate 30 is pushed upwards by the urging force F of the spring 39 in the direction shown by the solid line in FIG. 4. Paper sheets stacked on the plate 30 can be thus pushed against the paper feeder roller 11.

The rear end 30B of the paper feeder plate 30 is swingably held in this case by the front end 50T of the cover 50 which is projected outside the housing 1 (or by the slots 53 in the front end 50T) through the pins 31. Even when a large number of paper sheets is set on the paper feeder plate 30, therefore, the angle θ of the paper sheets entered can be kept almost same as the optimum one θ1 at which smooth paper feeding can be established as shown in FIG. 10A. This enables top one paper sheet to be smoothly fed in the direction Q at all times, thereby preventing paper sheet jamming from being caused.

Every paper sheet thus picked up is then conveyed in the direction X or to the printer section by the paper sheet conveying mechanism 70 and printed in the printer section. When no paper sheet is left on the paper feeder plate 30, a new stack of paper sheets is supplied as follows.

The paper feeder plate 30 which is in its position shown by the solid line in FIG. 4 is pushed down against the urging force F of the spring 39 by hand. The hand is released from the plate 30 in this case when the plate 30 is pushed down until the lock member 41 shown in FIG. 5 passes over the hook member 46. The paper feeder plate 30 is thus pushed back upwards by the urging force F of the spring 39. The lock mechanism (41, 46) operates this time to lock the paper feeder plate 30 at its paper supply position shown by the two-dot and dash line in FIG. 4. Similarly to the first paper sheet setting case, therefore, the operator can more quickly supply the new stack of paper sheets on the plate 30 by his both hands.

Figure 6:
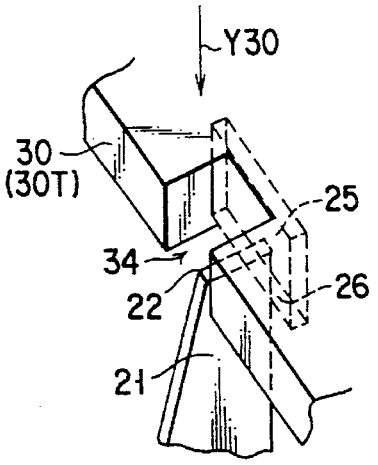
FIG. 6 is a perspective view showing a stopper mechanism for stopping the overshooting of the paper sheet mounted plate which is pushed down as shown in FIG. 4.

When unexpected and too large force is added to push down the paper feeder plate 30, the stopper mechanism 20 (22, 25) serves to control the lower limit of the paper feeder plate 30, as shown in FIG. 6. The paper feeder plate 30 cannot be therefore pushed down to an excessive extent, thereby preventing an excessive number of paper sheets from being supplied and also preventing the spring 39 from being over-shrunk. As the result, the paper feeder plate 30 can be prevented from rapidly and severely springing up when the hand is released from the plate 30. The actuator 60 and others can be thus protected from being too extremely shocked and therefore from being broken. This makes it unnecessary to carefully carry out paper supply work, thereby enabling a more quick paper supply work to be attained, as compared with the conventional cases.

When the printing process is finished and the cover 50 is then to be closed as shown in FIG. 8, the knob 59 of the cover 50 which is still in its opened state is lifted up. In short, the cover 50 is swung round its rear end 50B or rod 51 in the direction R1, as shown in FIG. 7.

When the cover 50 is swung in the direction R1, the housing mechanism (31, 53, 6, 35) becomes operative. As the cover 50 is swung, the pins 31 in the rear end 30B of the paper feeder plate 30 are moved along the slots 53 firstly in the direction X10 and guide pins 35 in the front end 30T thereof are moved down along the guide grooves 6, as shown in FIG. 7. The paper feeder plate 30 therefore comes nearer to the cover 50 while gradually becoming more and more parallel to it.

Although force in the direction X35 which is a sum of component force by the urging upward force F of the spring 39, and of weight of the paper feeder plate 30 is added to the guide pins 35, the cover 50 can be lightly pushed up in the direction R1 thanks to the pushing-down force Fd caused by the forcing mechanism (7, 36). The pins 31 are moved along the slots then in the direction X11 when the cover 50 comes on the way of its being closed.

When the cover 50 is thus closed as shown in FIG. 8, the paper feeder plate 30 is housed, substantially parallel, in the erected cover 50. Even if the paper feeder plate 30 is larger in size, therefore, it can be housed in a smaller space. This makes the printer apparatus to be made smaller in size.

According to the above-described embodiment, the rear end 30B of the paper feeder plate 30 is swingably supported by the front end 50T of the cover 50 which serves as the outer of the housing 1 when the cover 50 is opened. Further, the spring 39 is arranged between the front end 30T of the plate 30 and the cover 50. When the cover 50 is opened, therefore, the rear end 30B of the paper feeder plate 30 is projected outside the housing 1 but the whole thereof is housed in the housing 1 when the cover 50 is closed.

Therefore, a relatively larger-sized paper feeder plate 30 can be housed in a smaller space and the whole length of the plate 30 can be made larger enough. As the result, the angle of the paper feeder plate 30 tilted to meet any change in height of paper sheets stacked on the plate 30 can be kept relatively small and even when the paper sheets stacked on the paper feeder plate 30 become unexpectedly large in number, therefore, the angle of these paper sheets fed can be kept almost unchanged. A paper sheet feeder device can be thus provided capable of making the printer apparatus smaller in size, preventing paper sheet jamming, more smoothly feeding paper sheets, and more smoothly carrying out printing operation even when a larger number of paper sheets is stacked on the paper feeder plate.

Further, the paper sheet feeder device includes the lock mechanism for locking the paper feeder plate 30 at the paper supply position and the unlock mechanism for automatically unlocking the lock mechanism as the paper feeder roller 11 is rotated. When a new stack of paper sheets is to be supplied, therefore, the paper feeder plate 30 can be locked at the paper supply position but this lock can be automatically unlocked in response to the rotation of the paper feeder roller 11. An optimum number of paper sheets can be thus more quickly and easily supplied every time it is asked. In addition, the handling of the device can be made extremely easier.

Still further, the lock mechanism (41, 46) automatically locks the pushed-down paper feeder plate 30 at the paper supply position and keeps it locked. This makes it unnecessary for the operator to use his one hand to push down the paper feeder plate 30, which was seen in the conventional paper sheet feeder device shown in FIG. 1, when a new stack of paper sheets is to be supplied to the plate 30. He can therefore use his both hands to more stably supply the new stack of paper sheets to the plate 30. In addition, the paper feeder plate 30 can be automatically locked in the paper supply position by the pushing-down force F of the spring 39 when the cover 50 is firstly opened. He can therefore set the stack of paper sheets at once on the plate 30 without pushing it down by hand.

Still further, the stopper mechanism 20 controls the lower limit of the paper feeder plate 30 when the plate 30 is pushed down by external force added and after the lock member 41 passes over the hook member 46. This prevents the paper feeder plate 30 from being lowered to an unnecessary extent. This also previously prevents an excessive number of paper sheets from being stacked on the paper feeder plate 30. In addition, the overshrinking of the spring 39 can be prevented when the lower limit of the paper feeder plate 30 is controlled in this manner. The paper feeder plate 30 can be therefore kept not severely and rapidly sprung up, thereby preventing the actuator 60 for the paper sheet detector from being broken by the plate 30.

Still further, when the cover 50 is to be closed, the stopper mechanism 20 (21, 22) can be housed in the cut-away recess 34 of the paper feeder plate 30 not to disturb the housing of the plate 30 into the cover 50.

Still further, the rear end 30B of the paper feeder plate 30 is provided with the pins 31, the front end 50T of the cover 50 is provided with the slots 53 which extend in the paper feeding direction when the housing 1 is kept open, and these pins 31 are slidably held in the slots 53. The paper feeder plate 30 is thus swingably held by the cover 50. In addition, the arc-shaped guide grooves 6 are formed in the housing 1, extending from above to below and to the rotating center of the cover 50, and the front end 30T of the paper feeder plate 30 is provided with the guide pins 35 which can slide along the guide grooves 6. The housing mechanism (31, 53, 6, 35) thus formed enables the paper feeder plate 30 to be housed, substantially parallel, in the cover 50, while using the closing operation of the cover 50. Even when the whole length of the plate 30 is made larger, therefore, the space in which the plate 30 is housed in the housing 1 can be made by far smaller. When the housing mechanism is provided as described above, the paper feeder plate 30 can be prevented from interfering with the paper feeder roller 11 and other components. In addition, that angle of paper sheets fed onto the separator pad which must be changed as the number of paper sheets fed changes can be kept smaller, thereby preventing paper sheet jamming.

Still further, the tilted guide face 7 is provided, tilting from above to below and to the inside of the housing 1, and the paper feeder plate 30 is provided with the follower pins 36 which can slide along the tilted guide face 7. Using the closing operation of the cover 50, the forcing mechanism (7, 36) thus formed can generate forcing force Fd with which the front end 30T of the paper feeder plate 30 is made nearer and nearer to the cover 50 against the urging force F of the spring 39. Thanks to this forcing force Fd, therefore, the cover 50 can be more lightly and easily swung to more smoothly and automatically house the paper feeder plate 30 into it.

Still further, the cover 50 has the paper sheet tray 55 which can be pushed into and pulled out of it to more stably hold larger-sized paper sheets thereon.

It should be understood that the present invention is not limited to the above-described embodiment but that it can be variously changed and modified within its scope and spirit. Although the paper sheet feeder device has been incorporated into the printer apparatus in the above-described case, it may be incorporated into the paper sheet cassette, for example, which can be attached to and detached from the printer apparatus itself. The paper sheet feeder device according to the present invention can be used, as it is, in this case.

What is claimed is:

1. A paper sheet feeder device for a printer apparatus, the paper sheet feeder device comprising:

a paper feeder plate on which a stack of paper sheets is mounted, said paper feeder plate having a front end and a rear end;

a paper feeder roller arranged above the front end of said paper feeder plate and which is rotated to pick up the paper sheets one by one from the paper feeder plate;

supporting means for supporting the paper feeder plate to cause the paper sheets to be in contact with the paper feeder roller; and a paper sheet separator pad arranged adjacent to the front end of the paper feeder plate to introduce the paper sheets from the paper feeder plate to a certain position on an outer circumference of the paper feeder roller and to cooperate with the roller to separate a top one of the paper sheets from the stack of paper sheets;

wherein said supporting means includes a support section for swingably supporting the rear end of said paper feeder plate while keeping said rear end projected outside through an opening formed in a side of the printer apparatus, and an urging section for urging the paper feeder plate to the roller; and wherein said support and urging sections are provided on a cover which is swingably attached to a lower end of said opening of the printer apparatus.

2. The paper sheet feeder device according to claim 1, further comprising means for limiting an area into which said paper feeder plate is housed, while making said paper feeder plate substantially parallel to the cover against a force added by said urging section, when the cover is positioned to close the opening.

3. The paper sheet feeder device according to claim 2, wherein said support section includes a slider device for sliding said paper feeder plate to position said front end of said paper feeder plate below said paper feeder roller when said cover is set to open the opening.

4. The paper sheet feeder device according to claim 3, further comprising lock means which is enabled when said front end of said paper feeder plate is pushed down to a paper supply position against a force of said urging section by a force added from outside, to lock said front end of said paper feeder plate at the paper supply position against a force of said urging section when the outside force is released from said paper feeder plate.

5. The paper sheet feeder device according to claim 4, further comprising release or unlock means for releasing said front end of said paper feeder plate from the lock means as at a time when said paper feeder roller is rotated.

6. The paper sheet feeder device according to claim 5, further comprising stopper means for stopping said front end of said paper feeder plate from being pushed down to a position lower than the paper supply position against a force of said urging section by an outside force.

7. The paper sheet feeder device according to claim 1, further comprising lock means which is made operative when said front end of said paper feeder plate is pushed down to a paper supply position against a force of said urging section by a force added from outside, to lock said front end at the paper supply position against a force of said urging section when the outside force is released from said front end of said paper feeder plate.

8. The paper sheet feeder device according to claim 7, further comprising release or unlock means for releasing said front end of said paper feeder plate from said lock means as said paper feeder roller is rotated.

9. The paper sheet feeder device according to claim 1, further comprising stopper means for stopping said front end of said paper feeder plate from being pushed down to a position lower than a paper supply position against a force of said urging section by an outside force.

10. The paper sheet feeder device according to claim 1, wherein said cover includes a support plate which is pulled out of said cover in a direction away from and cooperating with said paper feeder plate to form a paper sheet table.

11. The paper sheet feeder device according to claim 1, wherein said support section includes:

first and second erections projected above from a front end of said cover, when the opening of said printer apparatus is opened, and wherein said first and second erections are opposed to each other with the paper feeder plate sandwiched between them;

third and fourth erections projected above from said rear end of said paper feeder plate and which are opposed to each other with the paper sheet-stacked area sandwiched between them; and first and second pivots connected to said first and second erections and to said third and fourth erections.

12. The paper sheet feeder device according to claim 11, wherein said first and second erections include first and second slits along which said first and second pivots are slid to set said front end of said paper feeder plate below said paper feeder roller when said cover is set to open the opening of said printer apparatus.

13. The paper sheet feeder device according to claim 1, further comprising forcing means for forcing said paper feeder plate to be parallel with said cover using a swinging force when said cover is swung to close the opening of said printer apparatus.

* * * * *